US005435354A

United States Patent [19]

Vezzu

[11] Patent Number: 5,435,354

[45] Date of Patent: Jul. 25, 1995

[54] ACCELERATOR LEVER FOR PROJECTILE LOOMS

[75] Inventor: Danilo Vezzu, Rüti, Switzerland

[73] Assignee: Sulzer Rueti AG, Rueti, Switzerland

[21] Appl. No.: 140,991

[22] Filed: Oct. 14, 1993

[30] Foreign Application Priority Data

Dec. 10, 1992 [EP] European Pat. Off. ..... 92810979

[51] Int. Cl.[6] ..... D03D 49/32

[52] U.S. Cl. ..... 139/145; 403/DIG. 9; 403/373

[58] Field of Search ..... 139/437, 438, 151, 157, 139/142, 147, 145, 156, 144, 146, 196.1, 196.2, 196.3; 403/373, DIG. 9, 110; 24/569; 74/105, 522, 525

[56] References Cited

U.S. PATENT DOCUMENTS

| | | | |
|---|---|---|---|
| 1,350,094 | 8/1920 | Davis | 139/147 |
| 2,715,422 | 8/1955 | Pfarrwaller | 139/145 |
| 3,041,888 | 7/1962 | Dehn | 74/525 X |
| 3,736,800 | 6/1973 | Gregory | 74/525 X |
| 4,184,382 | 1/1980 | Redman | 74/522 |
| 4,922,967 | 5/1990 | Pfarrwaller et al. | 139/145 |
| 5,033,514 | 7/1991 | Just et al. | 139/145 |
| 5,063,972 | 11/1991 | Pfarrwaller | 139/142 X |

FOREIGN PATENT DOCUMENTS

| | | |
|---|---|---|
| 1089664 | 3/1955 | France . |
| 1089665 | 3/1955 | France . |
| 473925 | 6/1969 | Switzerland . |
| 553864 | 7/1974 | Switzerland . |

*Primary Examiner*—Andrew M. Falik
*Attorney, Agent, or Firm*—Townsend and Townsend Khourie and Crew

[57] ABSTRACT

An accelerator lever for quickly accelerating a projectile to a high velocity in a loom comprises a lever arm (1*b*) coupled to a rotating shaft (2) by a clamping device (1*a*). The clamping device includes at least two fasteners (4*c*) extending through holes in the lever arm and the clamping device and threadably coupled to elements (4*a*) on the opposite side of the lever arm. The fasteners and elements provide a positive locking connection to firmly connect the lever arm to the shaft.

13 Claims, 4 Drawing Sheets

(A-A)

A
A
1
1a
1ac
1b
1c
1d
1e
1f
2
2a
2b
3
3a
4
4a
4b
4c
5
6
6a
7
8
9
10a
10b
10c
10d
10f
10r
10s
11
13

(B-B)

ACCELERATOR LEVER FOR PROJECTILE LOOMS

BACKGROUND OF THE INVENTION

The invention relates to an accelerator lever, particularly for projectile looms. It further refers to a projectile loom with an accelerator lever in accordance with the invention.

Striker or accelerator levers are used on projectile looms for accelerating a projectile to a high velocity in a short time. To achieve this it is helpful to keep the mass of the lever small to reduce the energy required for the acceleration of the mass of the lever and to increase the insertion capacity of a loom. CH-PS 553 864 discloses a lever for a projectile loom which has an arm made of fiber-reinforced duroplastic plastics and detachably connected to a clamping device for the transmission of forces. The surface of such a lever arm usually has a relatively low coefficient of friction. As a result the clamping device must generate a large clamping force which requires many bolts or bolts having large diameters. This renders the clamping device as well as the means of connection relatively massive since it is usually made of steel so that the large static and dynamic forces can be handled. A further disadvantage of the known accelerator lever is that the clamping device forms an edge where the lever arm protrudes from it. This leads to increased wear in that region as a result of the periodic back and forth motions of the lever arm. It has a further disadvantage that the large number of bolted connections make the replacement of the lever arm very time-consuming.

SUMMARY OF THE INVENTION

It is therefore an object of the invention to provide an accelerator lever made of at least the two parts, the clamping device and the lever arm, with a connection for the parts having a considerably reduced mass with few detachable connectors, and which makes it possible to make the parts of the accelerator lever of different materials. The accelerator lever should further have reduced wear in the region where the parts are connected. The accelerator lever should further be usable as a striker lever for the acceleration of the projectiles of a projectile loom which is capable of generating higher projectile velocities and hence higher weaving capacities.

The invention further covers the use of the device in accordance with the invention in projectile looms.

The clamping device and the lever arm are firmly and detachably connected in a locking manner relative to at least a direction of rotation of the lever. The lever arm and the clamping device have at least two apertures each; for example, drilled holes, to attain the desired locking connection in the direction of shaft rotation. At least two means of connection are necessary which typically extend parallel to the axis of rotation of the drive shaft for the accelerator lever and provide a stiff, positive connection in the direction of rotation of the lever. In comparison to frictional connections, the positive connection requires considerably less pressure between the lever arm and the clamping device. As a result, the clamping device and the lever arm are subjected to lesser forces in the region of their connection and, therefore, may have a lesser mass. One advantage of the invention is therefore that the connection can be built with fewer connectors and has a very low mass. A further advantage of the invention is that the lever can be made of different materials. Thus, metals such as, for example, steel, titanium or aluminum or composite materials such as fiber-reinforced plastics using endless carbon filaments, for example, are suitable materials. An accelerator lever can therefore be assembled or changed rapidly as may be required. Further elements such as, for example, a lever arm extension or a striker piece can be lockingly secured to the lever arm. Such an accelerator lever made of a number of components further permits the replacement of only individual components when maintenance is required.

Further, the existing problem of reliably connecting an accelerator lever made of plastic to the drive shaft is expediently solved by making the clamping device, for example, of metal and the lever arm of plastic. Hence very light accelerator levers can be produced which are easy to maintain, inexpensive and readily adaptable to the prevailing needs.

DETAILED DESCRIPTION OF THE PREFERRED EMBODIMENTS

Figures 1, 2A, 2B:
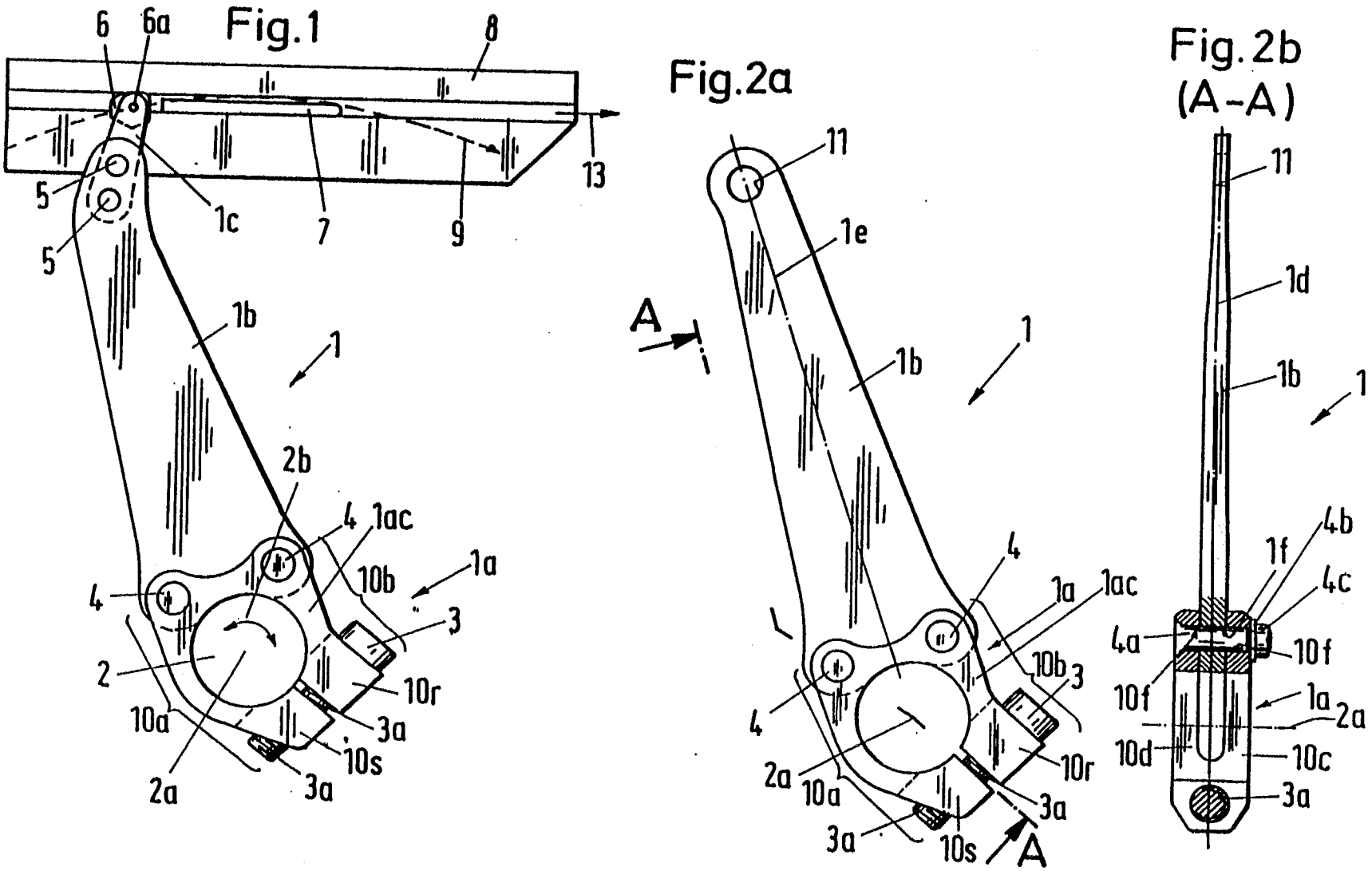
FIG. 1 is an accelerator lever of a projectile loom with a lever arm extension and a striker piece as well as a projectile.
FIG. 2*a* shows an embodiment of an accelerator lever.
FIG. 2*b* is a section along A—A through the accelerator lever according to FIG. 2*a;*

FIG. 1 shows an accelerator lever made in accordance with the invention and used as a striker lever on a projectile loom. A striker piece 6 moves along an arcuate path in the direction 9 to accelerate a projectile 7 guided by a projectile guide 8 in the direction 13 of weft insertion. Instead of the striker piece 6 movably mounted to a lever arm extension 1*c* and rotatable about a connector 6*a*, the striker piece may also be secured directly to an end region of the lever arm 1*b*, or to the lever arm extension 1*c*, in the form of a small plate of hard metal, for example. In the present embodiment the accelerator lever 1 is made of three components; namely, a clamp 1*ac*, a lever arm 1*b* and a lever arm extension 1*c*. The clamping device 1*a* comprises a single part, a clamp body 1*ac*. An accelerator lever can of course be made of more or of fewer parts. Shaft 2 moves the accelerator lever 1 back and forth in the direction of rotation 2*b*, the center of rotation 2*a* being perpendicular to the chosen view. The clamp body lac has a slit which is parallel to the axis of rotation 2*a* so that clamp body 1*ac* has two arms 10*a*, 10*b* embracing the shaft 2. Two ends 10*r*, 10*s* of the arms are connected with connector 3, e.g., a bolt with a threaded shaft 3*a*. Beginning with connector 3, the clamp body 1*ac* has on the side opposite the axis of rotation 2*a* at least two recesses 10*f* for receiving fasteners 4. Lever arm 1*b* has corresponding apertures 1*f*, so that fasteners 4 form a positive connection between clamp 1*ac* and lever arm 1*b* relative to the direction of rotation 2*b*. This connection must be free of play in the direction of motion 9. Thus, fasteners 4 are preferably arranged parallel to the axis of rotation 2*a*. At the end remote from the shaft 2 lever arm 1*b* has at least two further drilled holes for connectors 5 to lockingly attach lever arm extension 1*c* to the lever arm 1*b* relative to the motion direction 9. In the present embodiment the striker piece 6 is secured to the lever arm extension 1*c*. Detachable connectors 4 and 5 permit the individual components of the accelerator lever 1 to be individually exchanged or replaced. An accelerator lever 1 may be assembled from components in a very simple manner. The needed components can be selected to best suit a particular need at any given time because components made of different materials having desired properties such as, for example, their strength or weight, can be selected and assembled into a complete accelerator lever 1.

Figure 4A:
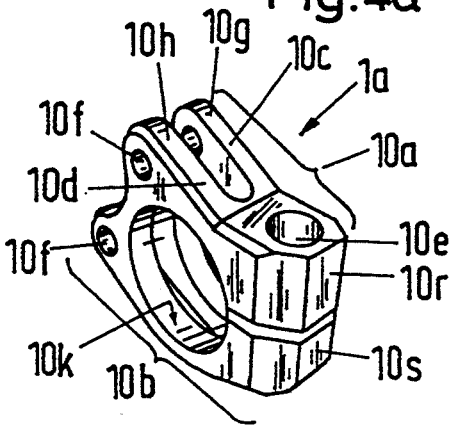
FIGS. 4*a* to 4*f* are perspectives of the clamping bodies.

The perspective view of the clamping device 1*a* in FIG. 4*a* shows the pair of arms 10*a* and 10*b* for embracing shaft 2, the ends 10*r* and 10*s* of the pair of arms each having an aperture 10*e* for receiving fastener 3. The clamping device 1*a* is frictionally connected to shaft 2. The friction generating pressure can be varied with fastener 3. Clamping device 1*a* and with it the entire accelerating lever 1 can be separated from the shaft 2 in a simple manner by loosening fastener 3. Beginning with the two ends 10*r* and 10*s* of the arms, the clamping device la has two further arms 10*c* and 10*d* which lie in a plane perpendicular to the center of rotation 2*a*. The two arms 10*c* and 10*d* include a bore 10*k* through which shaft 2 extends. Each arm further has at least two apertures 10*f* which receive fasteners 4 for a positive, locking connection to lever arm 1*b*. Movements of the accelerator lever 1 transverse to the direction of rotation 2*b* are reduced by appropriately forming the two parallel arms 10*c*, 10*d* between which the lever arm 1*b* is disposed. Flanges 10*g* and 10*h* of arms 10*c*, 10*d* support lever arm 1*b*.

Figure 4B:
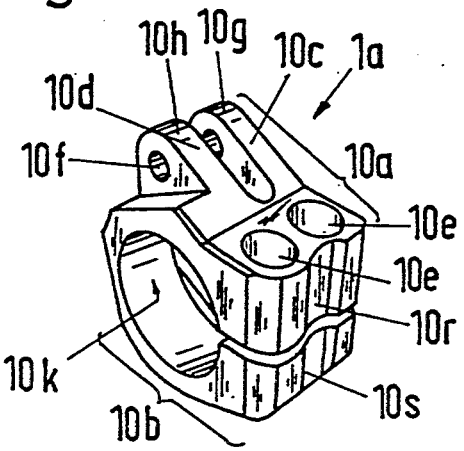
Figure 4C:
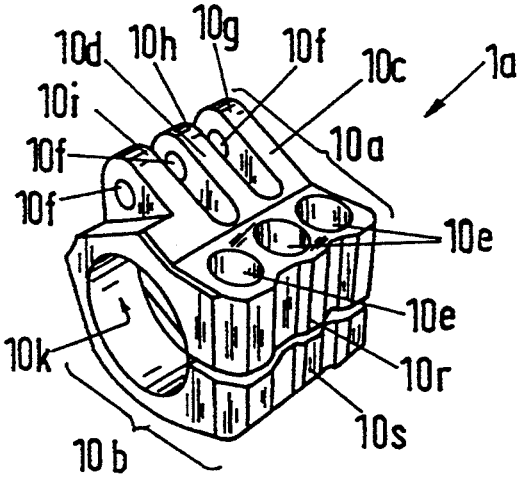

FIG. 4*b* shows a further embodiment of a clamping device 1*a* with arms 10*c* and 10*d* which, in comparison with FIG. 4*a*, are considerably wider in the direction of rotational axis 2*a* so that two apertures 10*e* can be positioned in ends 10*r* and 10*s* of the arms for securing the clamping device. Clamping device 1*a* can of course be made still wider so that more than two apertures 10*e* can be provided. The torque which can be transmitted from shaft 2 to clamping device 1*a* is amongst others dependent on the size of the surfaces in contact with each other and on the magnitude of the applied clamping force which establishes the friction connection. To increase the contact area between shaft 2 and clamping device 1*a* flanges 10*g*, 10*h* can be widened in the direction of the shaft 2, as shown in FIG. 4*c*, or the clamping device 1*a* may include flange 10*i*, with all flanges connected together by ends 10*r*, 10*s* of the arms. In the same way the number of apertures 10*e* in the ends 10*r*, 10*s* of the arms and hence the number of fasteners employed can be varied so that the necessary pressure can be generated as is shown in FIG. 4*c*. By forming the region of the clamping device to which lever arm 1*b* is secured in such a way that lever arm 1*b* has to be attached identically to the differing configurations of the clamping device 1*a*, different clamping devices 1*a* and lever arms 1*b* may be combined in any desired manner. Thus, for example, depending upon the weft insertion capacity or the mass of the projectile 7, different accelerator levers can be assembled. If a relatively small torque is to be transmitted from the shaft 2 to the clamping device 1*a*, a narrow and correspondingly light clamp 1*a* can be employed, so that the inertia of the entire accelerating lever 1 can be adapted to its use.

Figure 4D:
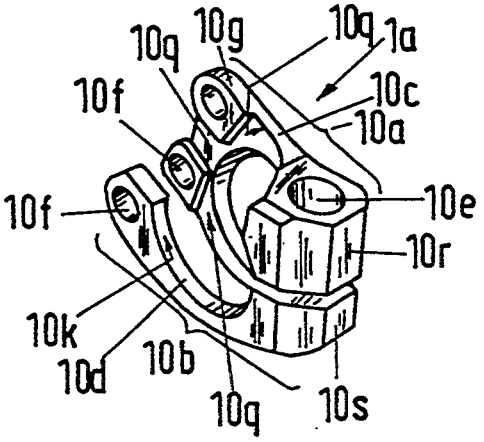
Figure 4E:
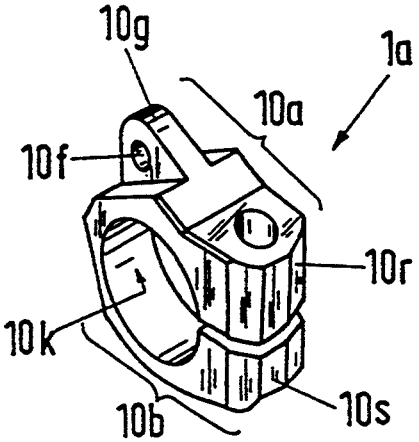
Figure 4F:
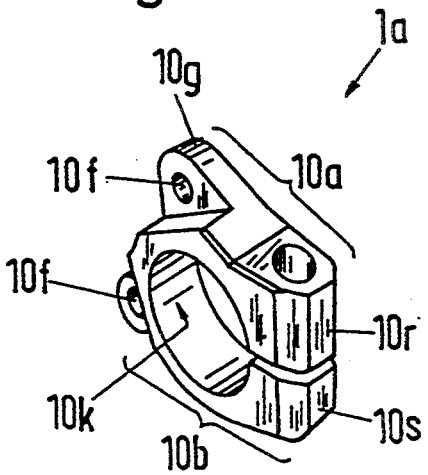

FIG. 4*d* shows a further clamping device 1*a* which, in contrast to FIG. 4*a*, has recesses 10*q* on the inside of the two arms 10*c*, 10*d*. This reduces the area of contact between clamping device 1*a* and lever arm 1*b*. FIG. 4*f* shows another clamping device 1*a* which has only a single pair of arms 10*a*, 10*b* embracing shaft 2 ending in arm ends 10*r*, 10*s*. A flange 10*g* includes an aperture 10*f* for connection to lever arm 1*b*. FIG. 4*e* shows a configuration similar to FIG. 4*f* and differs therefrom in that lever arm 1*b* does not rest flat against flange 10*g* for securing it to clamping device la. Flange 10*g* is formed only in the region of aperture 10*f*.

FIG. 2*a* shows an embodiment of an accelerator lever 1 with clamping device 1*a* to which lever arm 1*b* is secured by means of at least two fasteners 4. The end of lever arm 1*b* remote from the clamp body 1*ac* has a hole 11 which can be connected to a weft insertion mechanism for projectile 7 (not shown). The lever arm 1*b* is symmetric about a plane of symmetry 1*e* and about a plane of symmetry 1*d*. FIG. 2*b* shows a cross-section taken along line A—A. In the region of connection lever arm 1*b* is embraced on both sides by arms 10*c* and 10*d*, which exert pressure on lever arm 1*b* generated by connector 4*a*, 4*b*, 4*c*. Connector 4*a*, with aperture if and the two apertures 10*f*, forms a positive, locking connection. Lever arm 1*b* and clamp body 1*ac* are both symmetrical about the plane of symmetry 1*d*. Lateral movements of accelerator lever 1 in the direction of rotational axis 2*a* are thereby reduced.

Figure 3B:
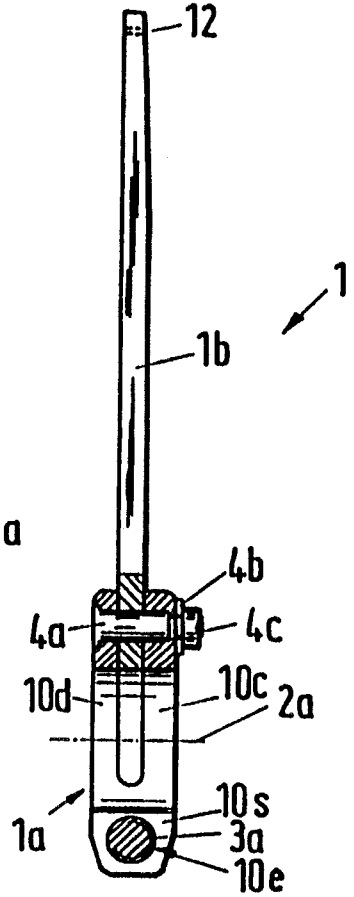
FIG. 3*b* is a section along B—B through the accelerator lever according to FIG. 3*a;*
Figure 3A:
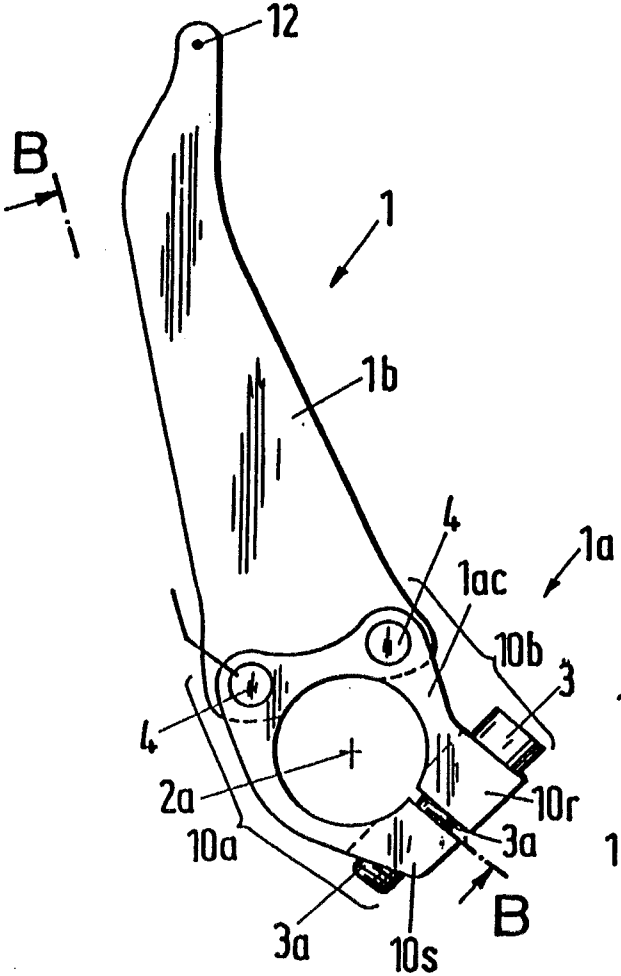
FIG. 3*a* shows an embodiment of another accelerator lever.

FIG. 3*a* shows an embodiment of an accelerator lever 1 which comprises a clamping device 1*a* to which a lever arm 1*b* is secured with at least two fasteners 4. At the end remote from the clamp body lac lever 1*b* includes a drilled hole 12 for attaching a striker piece with a connector 6*a*. FIG. 3*b* is a section taken along line B—B. The accelerator lever 1 is perpendicular to the axis of rotation 2*a* of the shaft 2. Ends 10*r*, 10*s* of the arms of the clamp body 1*ac* are secured to each other with a connector 3 including a threaded body 3*a*. The two arms 10*c* and 10*d* abut lever arm 1*b* and connector 4 with its components 4*a*, 4*b*, 4*c* forms a positive, locking connection which presses the two arms 10*c* and 10*d* against the lever arm 1*b* with an adjustable prestress. Prestress is not an absolute necessity but it can be advantageous, for example, to reduce lateral lever arm motions parallel to the axis of rotation 2*a*. In the vicinity of clamping device 1*a* lever arm 1*b* may be provided with two arms, made in the shape of a U and having corresponding apertures, for attachment to a clamping device 1*a* made, for example, as shown in FIG. 4*c*. In such a case the two arms will be disposed between the flanges 10*g*, 10*h*, 10*i* of the clamping body 1*a*. This provides a positive locking connection between the clamping body 1*a* and the lever arm 1*b* which is very stiff and permits the transmission of large torques.

In contrast to FIG. 2*b*, the lever arm 1 of FIG. 3*b* is not symmetric. Arms 10*c*, 10*d* of the clamping device 1*a* have different widths, in which case the aperture 10*e* in the end 10*s* of the arm is asymmetrically arranged in such a way that arms 10*c*, 10*d* have the same stress per unit area in the circumferential direction.

Figure 5:
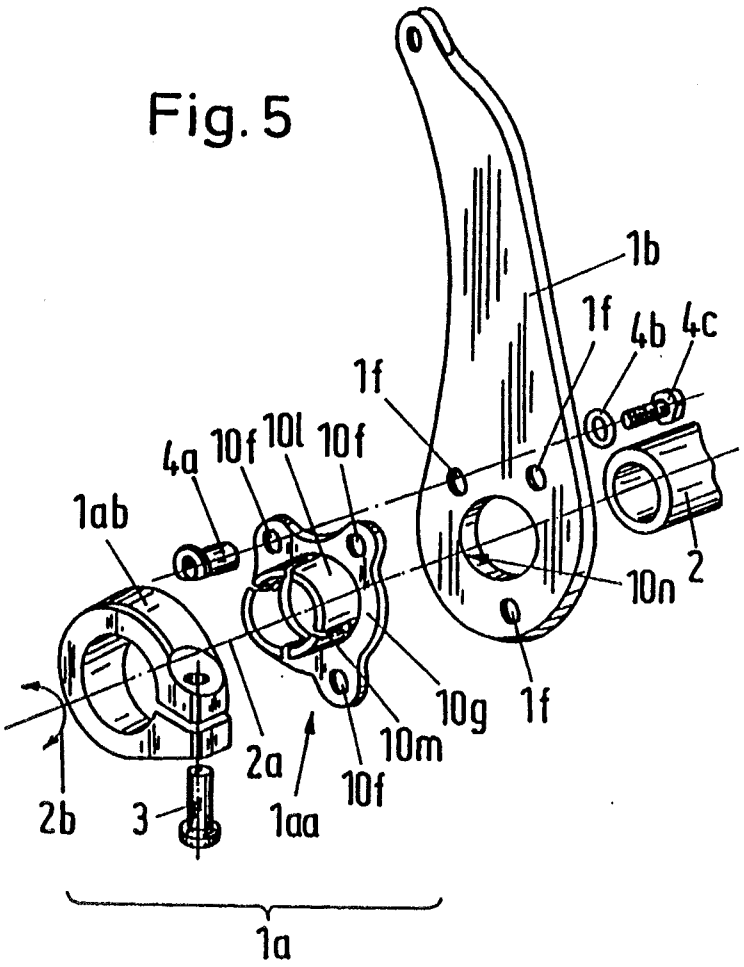
FIG. 5 shows a further embodiment of an accelerator lever of a projectile loom with a clamping device made of a number of parts.

FIG. 5 shows a further embodiment of an accelerator lever composed of at least one clamping device 1*a* and one lever arm 1*b*. The clamping device 1*a* includes a flanged bushing 1*aa* and a separate clamping ring 1*ab*. The flanged bushing 1*aa* includes a flange 10*g* which is perpendicular to the axis of rotation 2*a* of the shaft 2 and which has apertures 10*f*. The cylindrical portion 101 of the bushing has slits 10*m* which are parallel to the axis of rotation 2*a*. Clamping ring 1*ab* extends about the cylindrical portion 101 and detachable connector 3 tightens the clamping ring 1*ab* to form a releasable friction connection between the cylindrical portion 101 and shaft 2. The lever arm 1*b* again has at least two apertures if which are spaced apart in the direction of rotation 2*b*. Connectors 4*a*, 4*b*, 4*c* between the lever arm 1*b* and the flanged bushing 1*aa* establish a positive, locking connection at least with respect to motions in the direction of rotation 2*b*. In addition to the configuration of the lever arm 1*b* already disclosed, for example, in FIG. 1, the lever arm includes a bore 10*n* at its center of rotation 2*a*. The bore has a diameter which is sufficiently larger than the diameter of the shaft 2 so that, when mounted, the lever arm 1*b* encloses shaft 2.

Figure 6:
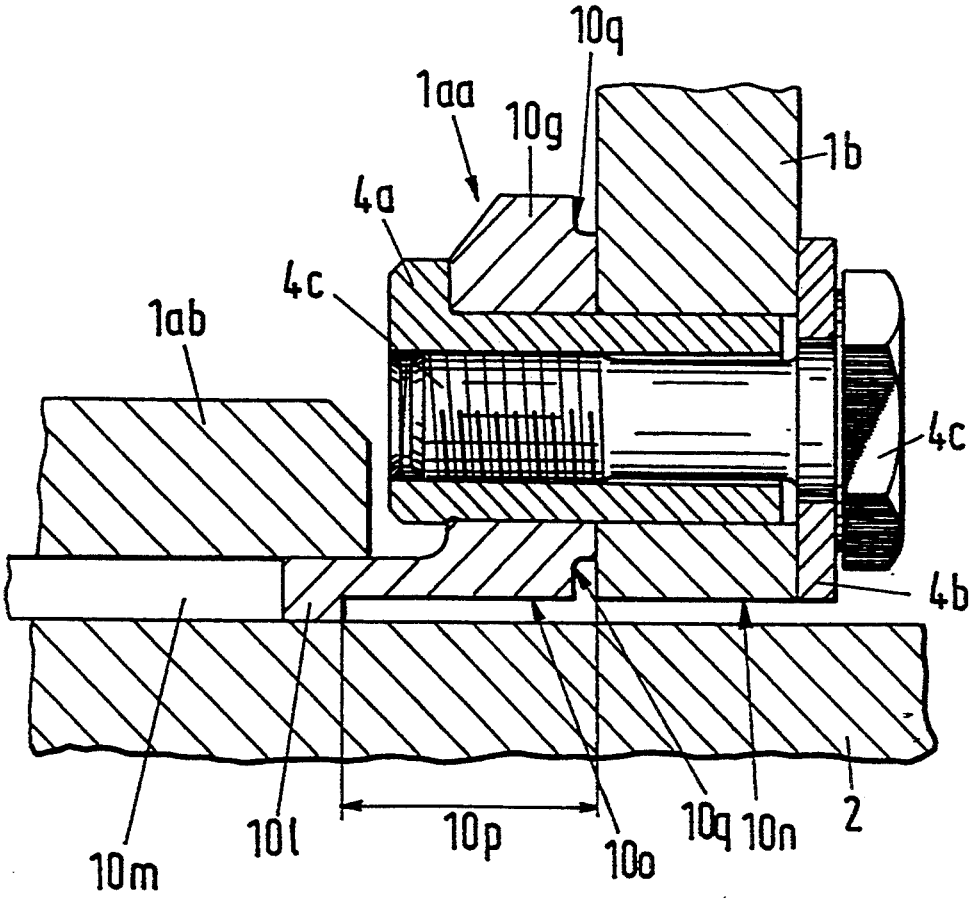
FIG. 6 is a detail of FIG. 5 showing the clamping device and its attachment to the lever arm and the shaft.

FIG. 6 is a detail of FIG. 5 and shows a further embodiment of a flanged bushing 1*aa*. The flanged bushing 1*aa* includes the flange 10*g* and a cylindrical bushing portion 101 with slits 10*m* parallel to shaft 2. In the region of the flange 10*g* the cylindrical bushing portion has a bore 10*o* of a diameter which is larger than the diameter of the shaft 2 and of a length 10*p* which is greater than the width of the flange 10*g*, so that, in the region of the flange 10*g*, the cylindrical portion 101 and the shaft 2 are not in contact. The side of flange 10*g* next to lever arm 1*b* further has a recess 10*q* to reduce the area of contact between the lever arm 1*b* and the flange 10*g*. The flange 10*g* and the lever arm 1*b* are secured to each other with connector 4*a*, 4*b*, 4*c*. The clamping ring 1*ab* grips the cylindrical bushing portion 101 in such a way that, when tightened, a frictional connection results between it and shaft 2. To enhance the connection the cylindrical bushing portion 101 can be provided with slits 10*m* which are distributed about the circumference of shaft 2.

What is claimed is:

1. An accelerator lever for accelerating a projectile, the lever being driven by a generally cylindrical shaft rotating in a direction about an axis, the lever comprising:

a lever arm having first and second ends and at least two openings spaced apart in the direction of rotation, the lever arm including a generally cylindrical bore concentric with the axis and having a diameter which is greater than a diameter of the shaft;

a clamping device having at least two apertures aligned with the openings; and fastening means for detachably connecting the first end of the lever arm to the clamping device, the fastening means extending through at least one of the apertures and at least one of the openings to form a positive, locking connection between the lever arm and the clamping device with respect to movement in the direction of rotation.

2. An accelerator lever as in claim 1, further including a lever arm extension and a detachable means for connecting the lever arm extension to the second end of the lever arm to form a positive locking connection with respect to a movement in the direction of rotation.

3. An accelerator lever as in claim 2 wherein the lever arm extension includes an aperture at an end remote from the clamping device.

4. An accelerator lever as in claim 1 wherein the lever arm and the clamping device are made of a composite material.

5. An accelerator lever for accelerating a projectile, the lever being driven by a shaft rotating in a direction about an axis, the lever comprising:

a lever arm having first and second ends and at least two openings spaced apart in the direction of rotation;

a clamping device having at least two apertures aligned with the openings, the clamping device being made in one piece and defining a clamping body having first and second arms extending about the shaft, the arms having ends each having at least one hole, and means, extending through the holes, for connecting the ends of the arms releasably to each other such that a releasable frictional connection is formed between the arms and the shaft; and fastening means for detachably connecting the first end of the lever arm to the clamping device, the fastening means extending through at least one of the apertures and at least one of the openings to form a positive, locking connection between the lever arm and the clamping device with respect to movement in the direction of rotation.

6. An accelerator lever as in claim 5 wherein the arms each have partial regions that embrace the shaft, each partial region including a flange which extends perpendicular to the axis, the apertures being formed in the flange.

7. An accelerator lever as in claim 5 wherein the holes are arranged in the ends of the arms so that the fastening means generates a circumferential stress in the arms.

8. An accelerator lever as in claim 6 wherein the flanges have planar opposite faces that are perpendicular to the axis.

9. An accelerator lever as in claim 6 wherein the flanges include recesses on a side proximate the lever arm to reduce an area of contact between the flange and the lever arm.

10. An accelerator lever for accelerating a projectile, the lever being driven by a shaft rotating in a direction about an axis, the lever comprising:

a lever arm having first and second ends and at least two openings spaced apart in the direction of rotation;

a clamping device having at least two apertures aligned with the openings comprising:

a flanged bushing having a flange oriented perpendicular to the axis and a cylindrical portion oriented parallel to the axis, the apertures extending through the flange;

a clamping ring disposed around the cylindrical portion; and detachable means for tightening the clamping ring around the cylindrical portion to form a releasable frictional connection between the cylindrical portion and the shaft; and fastening means for detachably connecting the first end of the lever arm to the clamping device, the fastening means extending through at least one of the apertures and at least one of the openings to form a positive, locking connection between the lever arm and the clamping device with respect to movement in the direction of rotation.

11. An accelerator lever as in claim 10 wherein the cylindrical portion has an inner diameter at an end proximate the flange, the inner diameter including an enlarged section which is coaxial with the axis and which has an axial length corresponding to at least a width of the flange along which there is no contact between the cylindrical portion and the shaft.

12. A projectile loom with an accelerator lever for accelerating a projectile, the lever being driven by a shaft rotating in a direction about an axis, the lever comprising:

a lever arm having first and second ends and at least two openings spaced apart in the direction of rotation;

a clamping device having at least two apertures aligned with the openings; and fastening means for detachably connecting the first end of the lever arm to the clamping device, the fastening means extending through at least one of the apertures and at least one of the openings to form a positive, locking connection between the lever arm and the clamping device with respect to movement in the direction of rotation.

13. An accelerator lever for accelerating a projectile, the lever being driven by a shaft rotating in a direction about an axis, the lever comprising:

a lever arm having first and second ends and at least two openings spaced apart in the direction of rotation;

a clamping device having at least two apertures aligned with the openings;

a first fastener for detachably connecting the first end of the lever arm to the clamping device, the fastener extending through at least one of the apertures and at least one of the openings to form a positive, locking connection between the lever arm and the clamping device; and a second fastener for connecting the clamping device to the shaft such that the lever arm can be detached from the shaft without removing the clamping device from the shaft.

* * * * *